United States Patent [19]

Masuda et al.

[11] Patent Number: 4,582,029

[45] Date of Patent: Apr. 15, 1986

[54] VALVE TIMING CONTROL SYSTEM FOR INTERNAL COMBUSTION ENGINE

[75] Inventors: Shunji Masuda; Yasuyuki Morita; Hiroyuki Oda, all of Hiroshima, Japan

[73] Assignee: Mazda Motor Corporation, Tokyo, Japan

[21] Appl. No.: 530,740

[22] Filed: Sep. 9, 1983

[30] Foreign Application Priority Data

Sep. 10, 1982 [JP] Japan ..... 57-158566
Oct. 5, 1982 [JP] Japan ..... 57-175578

[51] Int. Cl.[4] ..... F01L 1/34
[52] U.S. Cl. ..... 123/90.16; 123/90.35
[58] Field of Search ..... 123/90.16, 90.35, 90.48, 123/315, 432, 90.55

[56] References Cited

U.S. PATENT DOCUMENTS

| | | | |
|---|---|---|---|
| 3,385,274 | 5/1968 | Shunta et al. | 123/90.35 |
| 3,422,803 | 1/1969 | Stivender | 123/90.16 |
| 3,704,696 | 12/1972 | Abell, Jr. | 123/90.35 |
| 4,285,310 | 8/1981 | Takizawa et al. | 123/432 X |

FOREIGN PATENT DOCUMENTS

| | | | |
|---|---|---|---|
| 6659 | of 1908 | United Kingdom | 123/90.16 |
| 6650 | of 1909 | United Kingdom | 123/90.16 |
| 955988 | 4/1964 | United Kingdom | 123/90.16 |
| 1303080 | 1/1973 | United Kingdom | 123/90.16 |

*Primary Examiner*—William R. Cline
*Assistant Examiner*—Peggy A. Neils
*Attorney, Agent, or Firm*—Gerald J. Ferguson, Jr.

[57] ABSTRACT

In an internal combustion engine, the movement of the cam on the camshaft is transmitted to each valve of each cylinder by way of a tappet member. The tappet member is held in a swinging member which can be swung about the camshaft. The swinging member is swung about the camshaft back and forth in the rotational direction of the camshaft by a control device according to the operating condition of the engine. When the swinging member is swung about the camshaft, the relative position of the tappet member to the cam at a given angular position of the camshaft is changed, whereby the valve timing of the valve associated with the tappet member is changed.

15 Claims, 10 Drawing Figures

VALVE TIMING CONTROL SYSTEM FOR INTERNAL COMBUSTION ENGINE

BACKGROUND OF THE INVENTION

1. Field of the Invention

This invention relates to a valve timing control system for an internal combustion engine, and more particularly to a valve timing control system for an internal combustion engine for changing the valve timing according to the operating condition of the engine.

2. Description of the Prior Art

Generally it is preferred from the viewpoint of engine performance that the valve timing of the intake valve and/or the exhaust valve be changed according to the operating condition of the engine. For example, during operation of the engine under light load, the valve overlap, i.e., the time that both the exhaust valve and the intake valve are open, is preferred to be short to reduce the amount of residual exhaust gas, whereby stability of combustion in the engine can be ensured. Further, during operation of the engine at a low speed under heavy load, backflow of intake gas can be prevented and the volumetric efficiency can be improved by reducing the valve overlap. On the other hand, in order to improve the volumetric efficiency during heavy load high speed operation of the engine, the valve overlap is preferred to be long.

Thus there have been proposed various valve timing changing mechanisms for an internal combustion engine. For example, there is disclosed in Japanese Patent Publication No. 52(1977)-35819 a valve timing changing mechanism in which a planet gear associated with a centrifugal governor is interposed between the output shaft and the camshaft of the engine to change the relative position of the camshaft to the output shaft. In another valve timing changing mechanism, a three-dimensional camshaft is used as the camshaft and the three-dimensional camshaft is slid to change the valve timing.

However, the conventional mechanisms are disadvantageous in the they are significantly complicated in structure, are apt to produce loud noise, respond poorly and have low reliability.

SUMMARY OF THE INVENTION

In view of the foregoing observations and description, the primary object of the present invention is to provide a valve timing control system for changing the valve timing according to the operating condition of the engine which can be realized without significantly changing the structure of the conventional valve trains or valve driving system, and accordingly which is simple in structure.

Another object of the present invention is to provide a valve timing control system which can change the valve timing with quick response and high reliability.

Still another object of the present invention is to provide a valve timing control system which does not generate loud noise.

In accordance with the present invention, the tappet member which transmits the movement of the cam on the camshaft to the valve stem to open and close the valve is slidably received in a tappet receiving hole formed in a swinging member which can be swung about the camshaft along with the tappet member held thereby. A control device for swinging the swinging member about the camshaft is provided. When the swinging member and accordingly the tappet member held thereby are swung with respect to the camshaft and accordingly to the cam thereon, the contacting point between the cam and the tappet member at a given angular position of the camshaft is changed, whereby the valve timing can be changed. The control device swings the swinging member according to the operating condition of the engine.

DESCRIPTION OF THE PREFERRED EMBODIMENT

Figure 1:
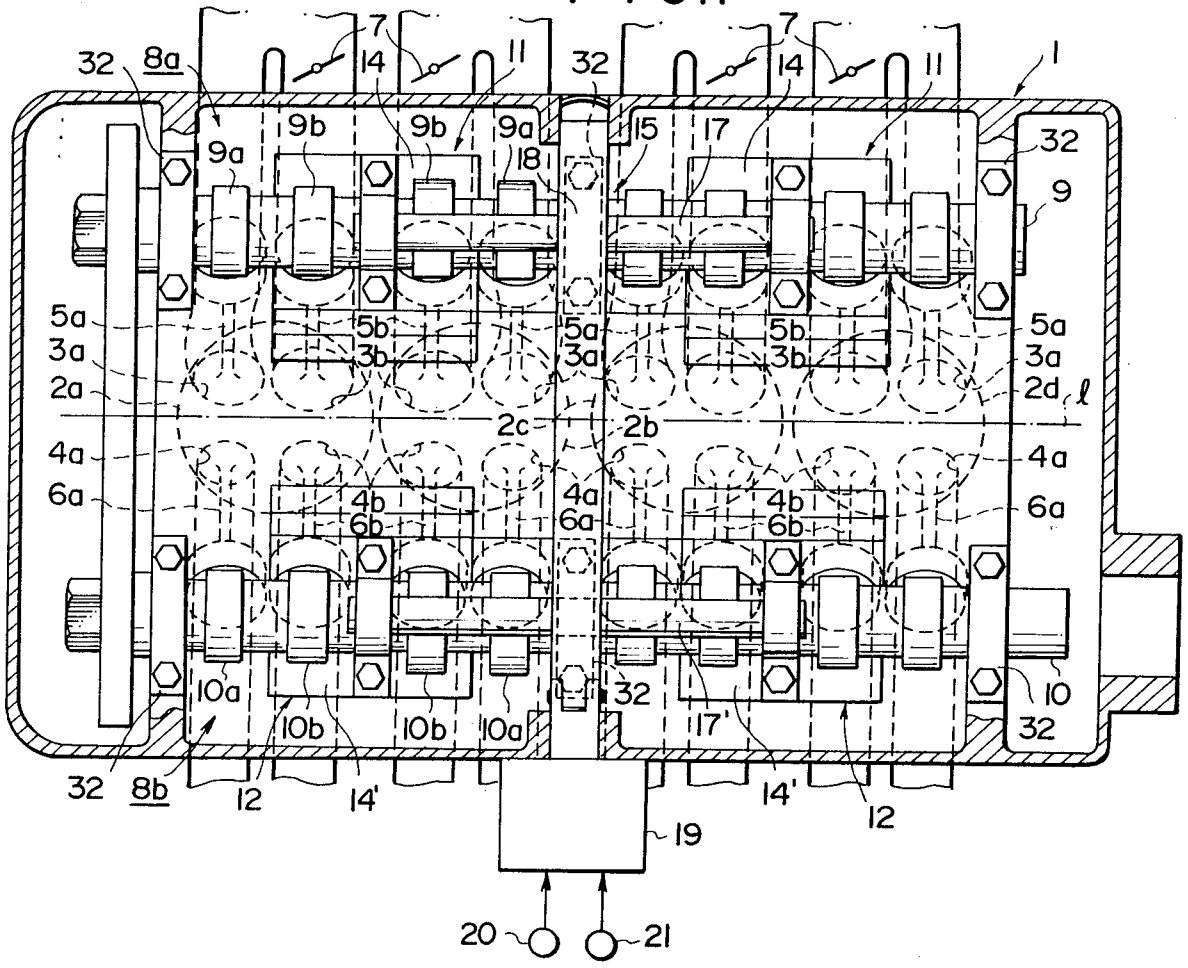
FIG. 1 is a schematic plan view of a dual-induction type four-cylinder engine employing a valve timing control system in accordance with an embodiment of the present invention.

FIG. 1 shows a dual-induction type four-cylinder engine having a pair of intake ports and a pair of exhaust ports for each cylinder and employing a valve timing control system in accordance with an embodiment of the present invention. In this engine the valve timing control system is used for changing the total intake valve opening time, i.e., the time that at least one intake valve is open, according to the operating condition of the engine.

In order to improve the engine output by making the volumetric efficiency high, generally it is preferred that the opening time of the intake valve, i.e., the time that the intake valve opens, be longer for a given area of the intake opening when the engine operates at a high rotational speed, and especially when the engine operates at a high speed under heavy load. When the engine operates at a high speed under heavy load, combustion in the engine is not adversely affected even if the opening time of the intake valve is extended and the valve overlap is extended, since the ratio of the residual exhaust gas to the intake gas is small and backflow of the intake gas does not occur because of high inertia speed of the intake gas under such operating condition of the engine. On the other hand, when the opening time of the intake valve is extended during operation of the engine at a low speed under heavy load, backflow of the intake gas occurs since the inertia speed of the intake gas is low, whereby the volumetric efficiency is lowered.

Thus it is preferred that the intake valve opening time be variable according to the operating condition of the engine. In the case of an engine having a pair of intake valves for each cylinder, the intake valve opening time can be changed by changing the valve timing of at least one intake valve. For example, when the intake valves are opened in the same timing, the intake valve opening time can be extended by retarding the opening timing of one intake valve with the opening timing of the other intake valve being fixed or advanced.

In FIG. 1, first to fourth cylinders 2*a* to 2*d* are formed in the engine block 1 in series along the center line l of the engine block 1. Each cylinder is provided with an intake port 3*a* for light load, an intake port 3*b* for heavy load, and first and second exhaust ports 4*a* and 4*b*. As will become apparent later, the intake port 3*b* for heavy load is actually used only when the engine operates under heavy load, while the intake port 3*a* for light load is always actually used irrespective of the load under which the engine operates. The light load intake port (the intake port for light load) 3*a* and the heavy load intake port (the intake port for heavy load) 3*b* of each cylinder open in the cylinder on one side of the center line l of the engine block 1 arranged in a line substantially parallel to the center line l. The cross sectional area of the passage leading to the light load intake port 3*a* is narrow to increase the flow velocity of intake gas passing therethrough and at the same time the passage leading to the light load intake port 3*a* is curved to produce swirls in the cylinder. On the other hand, the cross sectional area of the heavy load intake port 3*b* is relatively large to improve the volumetric efficiency. The first and second exhaust port 4*a* and 4*b* of each cylinder open in the cylinder on the other side of the center line l of the engine block 1 arranged in a line substantially parallel to the center line l. The light load intake port 3*a* and the heavy load intake port 3*b* are respectively opposed to the first exhaust port 4*a* and the second exhaust port 4*b*. The light load intake port 3*a* and the heavy load intake port 3*b* are arranged in this order from the left as seen in FIG. 1 in the first and third cylinders 2*a* and 2*c*, and in the reverse order in the second and fourth cylinders 2*b* and 2*d* so that the heavy load intake ports 3*b* of the first and second cylinders 2*a* and 2*b* are adjacent to each other and the heavy load intake ports 3*b* of the third and fourth cylinders 2*c* and 2*d* are adjacent to each other. Similarly, the first and second exhaust ports 4*a* and 4*b* are arranged in this order from the left as seen in FIG. 1 in the first and third cylinders 2*a* and 2*c*, and in the reverse order in the second and fourth cylinders 2*b* and 2*d* so that the second exhaust ports 4*b* of the first and second cylinders 2*a* and 2*b* are adjacent to each other and the second exhaust ports 4*b* of the third and fourth cylinders 2*c* and 2*d* are adjacent to each other.

The light load intake port 3*a*, the heavy load intake port 3*b*, the first exhaust port 4*a* and the second exhaust port 4*b* are provided with a light load intake valve 5*a*, a heavy load intake valve 5*b*, a first exhaust valve 6*a* and a second exhaust valve 6*b*, respectively, which open and close the corresponding ports in time.

The passages leading to the respective heavy load intake ports 3*b* are provided with a valve 7 which is opened only when the engine operates under heavy load. During light load operation of the engine, intake gas is introduced into each cylinder only through the light load intake port 3*a*, while during heavy load operation of the engine, intake gas is introduced into each cylinder through both the light load intake port 3*a* and the heavy load intake port 3*b* with the valve 7 being opened.

On the intake side of the engine block 1 is disposed a first valve driving mechanism 8*a* for controlling the light load intake valves 5*a* and the heavy load intake valves 5*b* of the respective cylinders 2*a* to 2*d*. The first valve driving mechanism 8*a* includes a first camshaft 9 which extends in parallel to the center line l of the engine block 1 on the intake side thereof and is rotated by the crankshaft (not shown) of the engine. The first camshaft 9 is provided with cams 9*a* for timing the light load intake valves 5*a* of the respective cylinders 2*a* to 2*d* and cams 9*b* for timing the heavy load intake valves 5*b* of the respective cylinders 2*a* to 2*d*. The cams 9*a* and the cams 9*b* are equal to each other in shape and size so that the intake valves 5*a* and 5*b* are opened for the same time interval.

Similarly, on the exhaust side of the engine block 1 is disposed a second valve driving mechanism 8*b* for controlling the first and second exhaust valves 6*a* and 6*b* of the respective cylinders 2*a* to 2*d*. The second valve driving mechanism 8*b* includes a second camshaft 10 which extends in parallel to the center line l of the engine block 1 on the exhaust side thereof, and is rotated by the crankshaft (not shown) of the engine. The second camshaft 10 is provided with cams 10*a* for timing the first exhaust valves 6*a* of the respective cylinders 2*a* to 2*d* and cams 9*b* for timing the second exhaust valves 6*b* of the respective cylinders 2*a* to 2*d*. The cams 10*a* and the cams 10*b* are equal to each other in shape and size so that the exhaust valves 6*a* and 6*b* are opened for the same time interval.

The movement of each cam is transmitted to the corresponding valve by way of a tappet member to open the valve when the cam lobe comes around to abut against the tappet member as is well known in the art, and the valve timing is determined by the angular position of the cam lobe with respect to the tappet member.

In this embodiment, the tappet member associated with the heavy load intake valve 5*b* and the tappet member associated with the second exhaust valve 6*b* are respectively supported by swinging members 14 and 14' which can be swung with respect to the first and second camshafts 9 and 10, respectively.

Figure 2:
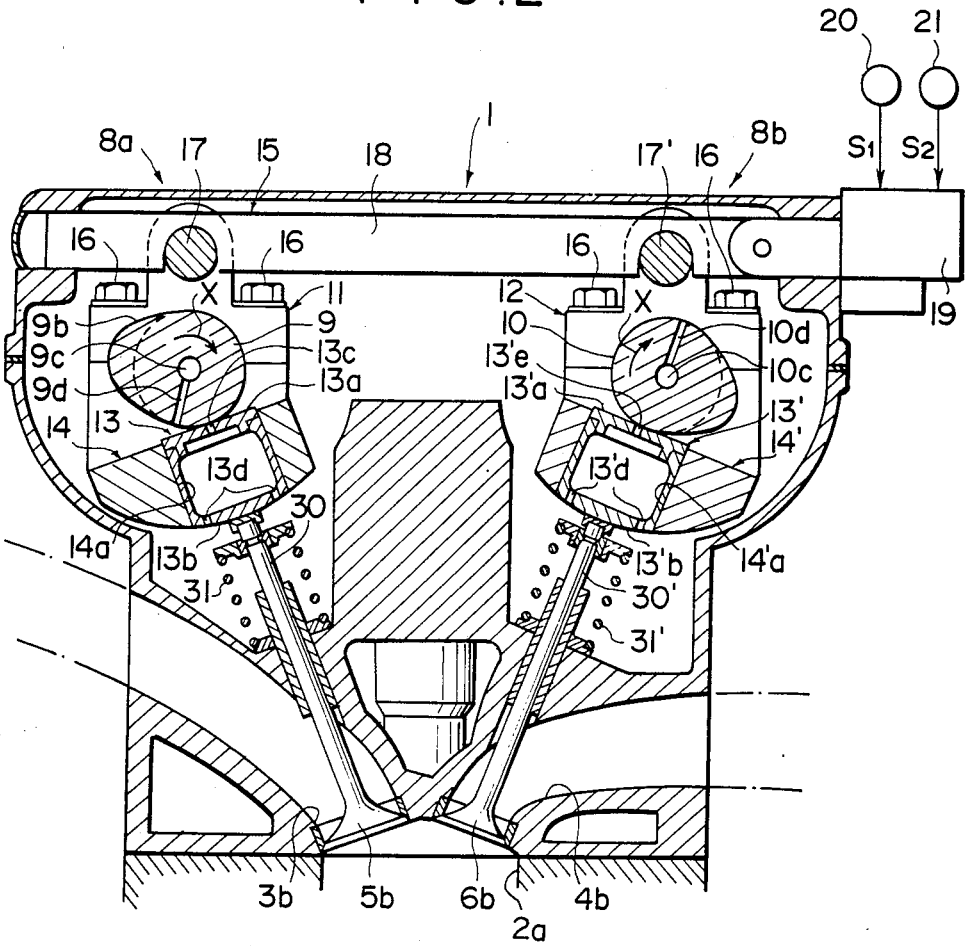
FIG. 2 is a fragmentary cross-sectional view of FIG. 1.

As shown in FIG. 2, the movement of the cam 9*b* for timing the heavy load intake valve 5*b* is transmitted to the valve stem 30 of the heavy load intake valve 5*b* by way of a tappet member 13 to move downward the heavy load intake valve 5*b* to open the heavy load intake port 3*b* when the cam lobe of the cam 9*b* comes around to abut against the tappet member 13. The tappet member 13 is like a box in cross section and has a cam abutting face 13*a* adapted to abut against the cam 9*b* and a valve stem abutting face 13*b* adapted to abut against the top surface of the valve stem 30 of the heavy load intake valve 5*b*. The heavy load intake valve 5*b* is urged upward by a coil spring 31 associated with the valve stem 30 to normally close the heavy load intake port 3*b*. The first camshaft 9 is provided with a longitudinal oil passage 9*c* which extends in the longitudinal direction of the camshaft 9 and is connected to an oil pump (not shown), and with a radial oil passage 9*d* through which oil fed through the longitudinal oil passage 9*c* under pressure flows outside to lubricate the surfaces of the cam 9*b* and the tappet member 13. The oil lubricating the surfaces drops toward the valve stem abutting face 13*b* through a central hole 13*c* in the cam abutting face 13*a* and lubricates the valve stem abutting face 13*b* through the small holes 13*d* formed in the valve stem abutting face 13*b* near the edges. Since when the swinging member 14 is swung to change the valve timing, the valve stem abutting surface 13*b* slides on the valve stem 30, it is preferred that the valve stem abutting surface 13*b* be lubricated.

The box-like tappet member is advantageous in that it has a substantial thickness in the direction of the movement of the valve and accordingly the valve stem can be shorter by the amount of thickness of the tappet member, whereby the adverse influence on the valve of forces exerted on the valve in directions other than the direction of the movement of the valve can be reduced.

In this particular embodiment, the tappet members 13 respectively associated with the heavy load intake valves 5*b* which are adjacent to each other are supported by a common swinging member 14. Accordingly, the engine shown in FIG. 1 is provided with a pair of swinging members 14 for changing the timing of the heavy load intake valves, one for changing the timing of the heavy load intake valves 5*b* of the first and second cylinders 2*a* and 2*b*, and the other for changing the timing of the heavy load intake valves 5*b* of the third and fourth cylinders 2*c* and 2*d*. Similarly, the tappet members 13' associated with the second exhaust valves 6*b* which are adjacent to each other are supported by a common swinging members 14'. Thus there are provided a pair of swinging members 14' for changing the timing of the second exhaust valves 6*b*. Since the swinging members 14 are identical to each other, only the swing member 14 for the first and second cylinders 2*a* and 2*b* will be described here.

Figure 3:
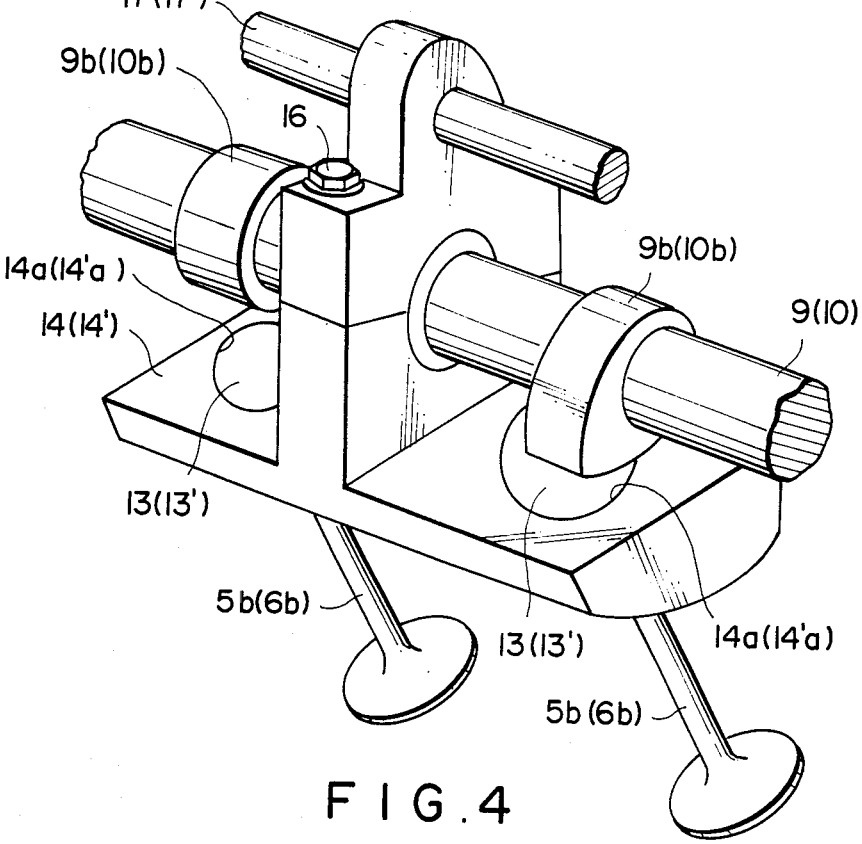
FIG. 3 is an enlarged perspective view of the valve timing changing mechanism employed in the valve timing control system shown in FIG. 1.

As shown in FIG. 3, the swinging member 14 is formed by an upper half having a semicircular recess on the lower end thereof and a lower half having a semicircular recess on the upper end thereof which are secured together by means of bolts 16 (only one bolt 16 is visible in FIG. 3) with the first camshaft 9 being snugly received in the circular opening formed by the semicircular recesses to permit swinging movement of the swinging member 14 about the first camshaft 9. A connecting rod 17 extends through the swinging member 14 at the top thereof above the first camshaft 9. The connecting rod 17 is operatively connected to a control device 15 to swing the swinging member 14 with respect to the first camshaft 9 under the control of the control device 15 as will be described in detail hereinafter.

A pair of tappet receiving holes 14*a* are provided in the horizontal portion of the swinging member 14. The tappet member 13 associated with the heavy load intake valve 5*b* of the first cylinder 2*a* is snugly received in one of the tappet receiving holes 14*a* for sliding movement substantially in the axial direction of the valve stem 30, and the same associated with the heavy load intake valve 5*b* of the second cylinder 2*b* is received in the other tappet receiving hole in the same manner.

Said connecting rod 17 extends in parallel to the center line l of the engine block 1 to connect both the swinging members 14. The control device 15 (See also FIGS. 1 and 2) comprises a reciprocating shaft 18 which extends in perpendicular to the center line l and is engaged with the connecting rod 17 to swing the connecting rod 17 in response to the reciprocating movement thereof, and a driving motor 19 which drives the reciprocating shaft 18 in reciprocation. An output signal S1 of a rotational speed sensor 20 and an output signal S2 of a load sensor 21 are inputted into the driving motor 19 in order to control it according to the operating condition of the engine. As can be seen from FIG. 2, when the swinging member 14 and accordingly the tappet member 13 held by the swinging member 14 are swung with respect to the first camshaft 9 and the cam 9*b* thereon, the contacting point between the cam 9*b* and the tappet member 13 at a given angular position of the first camshaft 9 is changed, whereby the valve timing is changed. For example, when the swinging member 14 is swung in the rotating direction of the first camshaft 9 indicated by the arrow X in FIG. 2, the valve opening timing is retarded, and vice versa. The driving motor 19 is controlled to swing the swinging member 14 and the tappet member 13 in the direction of the arrow X to retard the opening timing of the heavy load intake valve 5*b* by way of the reciprocating shaft 18 and the connecting rod 17 when it is determined that the engine operates at a high speed under heavy load by way of the output signals S1 and S2. Since both the swinging members 14 associated with the heavy load intake valves 5*b* of the first to fourth cylinders 2*a* to 2*d* are connected to the same connecting rod 17, all the heavy load intake valves 5*b* are changed in valve timing by the same amount at the same time. The movement of the cam 10*b* for timing the second exhaust valve 6*b* is transmitted to the valve stem 30' of the second exhaust valve 6*b* by way of a tappet member 13' which is identical to the tappet member 13 associated with the heavy load intake valve 5*b*. The swinging members 14' for changing the timing of the second exhaust valves 6*b* are identical to those for changing the timing of the heavy load intake valves 5*b* described above, and therefore will not be described in detail here. Components of the swinging members 14' are denoted by reference numerals in brackets in FIG. 3. The connecting rod 17' connecting the two swinging members 14' is operatively connected to the reciprocating shaft 18 of the control device 15 so that the swinging members 14' are swung in response to the reciprocating movement of the reciprocating shaft 18 together with the swinging members 14. Therefore, the heavy load intake valves 5*b* and the second exhaust valves 6*b* are changed in valve timing by the same amount in the same direction at the same time.

Again referring to FIG. 1, the first and second camshafts 9 and 10 are supported for rotation by bearing portions 32 which are positioned at the ends and an intermediate portion of the engine block 1 so as not to interfere with the swinging members 14 and 14' and to prevent flex of the camshafts 9 and 10.

Figure 5:
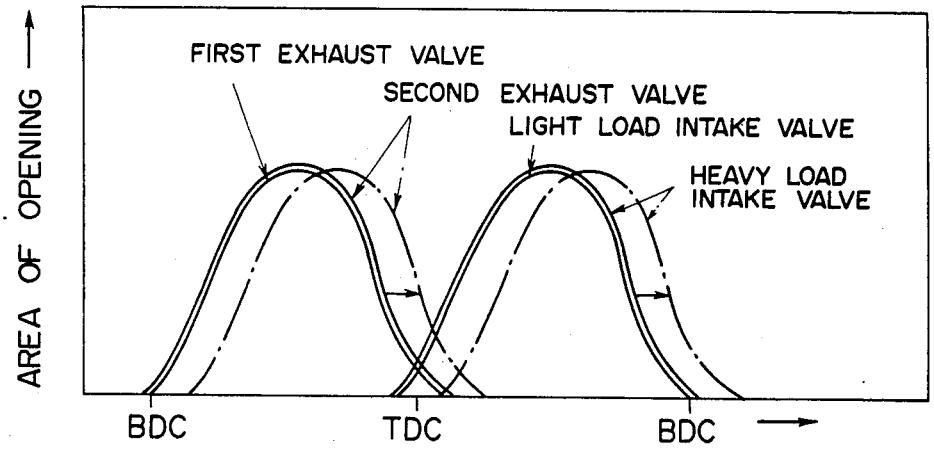
FIG. 5 is a view illustrating change in the valve timing made in accordance with the present invention.

When the engine is operating under light load, the swinging members 14 and 14' are in a normal position in which the light load intake valve 5*a*, the heavy load intake valve 5*b*, and the first and second exhaust valves 6*a* and 6*b* of each cylinder are opened and closed in a predetermined valve timing shown by solid lines in FIG. 5. That is, both the exhaust valves 6*a* and 6*b* start to open near BDC of the piston and close near TDC, while both the intake valves 5*a* and 5*b* start to open near TDC and close near BDC with the valve overlap (the time that the intake valve and the exhaust valve are both open) being kept short. Though the heavy load intake valve 5*b* is opened and closed during light load operation of the engine, intake gas cannot be fed through the heavy load intake port 3*b* since the valve 7 is closed.

Thus during light load operation of the engine, intake gas is introduced into each cylinder only through the light load intake port 3*a*. Therefore, intake gas is drawn into the cylinder at a high speed to generate a swirl therein, whereby the combustion rate in the combustion chamber can be increased to improve combustion therein. Further, the short valve overlap reduces the amount of residual exhaust gas, which contributes to improvement in combustion during light load operation of the engine.

When the engine is operating at a low speed under heavy load, the valve 7 in each heavy load intake port 3*b* is opened though the valve timing is kept as shown by the solid lines in FIG. 5, i.e., the control device 15 does not act on the swinging members 14 and 14'. Thus intake gas is introduced into the cylinder through both the light load intake port 3*a* and the heavy load intake port 3*b*. However, backflow of the intake gas does not occur since the total opening time of the intake ports is still kept relatively short and the intake ports are closed comparatively earlier. Accordingly, the volumetric efficiency is highly improved during heavy load low speed operation of the engine. Further, since exhaust gas is scavenged from the cylinder through the two exhaust ports 4*a* and 4*b* in this embodiment, the scavenging efficiency is increased as compared with the case where exhaust gas is scavenged through a single exhaust port. This also contributes to improvement in the volumetric efficiency.

When the engine is operating at a high speed under heavy load, the valve 7 in each heavy load intake port 3*b* is opened and at the same time the control device 15 acts on the swinging members to swing them to retard the valve timing of the heavy load intake valve 5*b* and the second exhaust valve 6*b* as shown by chained-lines in FIG. 5. At this time, the valve timing of the light load intake valve 5*a* and the first exhaust valve 6*a* is not changed. Thus the total intake valve opening time, i.e., the time that at least one of the light load intake valve 5*a* and the heavy load intake valve 5*b* is open, is extended by the amount by which the opening timing of the heavy load intake valve 5*b* is retarded. This, in addition to the fact that the total intake valve opening time is extended in the direction of retardation when the inertia of the intake gas is large, highly improves the volumetric efficiency, thereby increasing the power output of the engine during heavy load high speed operation of the engine.

At the same time, the total exhaust valve opening time is also extended in the exhaust stroke and the scavenging efficiency is improved, which also contributes to improvement in the volumetric efficiency. Further, since the amount of intake gas is large and the inertia velocity of the intake gas is high during heavy load high speed operation of the engine, the amount of residual exhaust gas can be made small and backflow of intake gas does not occur even if the valve overlap is extended and the opening time of the intake valve is retarded into the compression stroke. Accordingly, combustion in the engine is not be adversely affected.

As described above, the swinging members 14 and 14' are swung to change the valve timing by the driving motor 19 by way of the reciprocating shaft 18 and the connecting rods 17 and 17'. Now an example of a control system for controlling the driving motor 19 will be described referring to FIGS. 6 and 7.

Again referring to FIG. 2, the valve stem abutting surface 13*b* (13'*b*) of the tappet member 13 (13') is convex toward the valve stem 30 (30') and the center of curvature of the valve stem abutting surface 13*b* (13'*b*) is on the central axis of the camshaft 9 (10). This is desirable to keep the optimal valve clearance even when the swinging member 14 (14') is swung while the valve 5*b* (6*b*) is closed. At the same time the valve stem abutting surface is preferred to have a large radius of curvature since as the radius of curvature becomes small the contact area between the valve stem abutting surface and the top surface of the valve stem becomes small and the contact pressure therebetween is increased. As is well known when the contact pressure increases, the so-called PV value, i.e., the product of the sliding velocity V between the sliding surfaces, and the contact pressure P therebetween, is increased and wear of the surfaces is increased. The box-like tappet member is preferable in this respect since it has a substantial thickness as described above and accordingly the valve stem abutting surface is remote from the central axis of the camshaft, whereby the radius of curvature of the valve stem abutting surface can be made relatively large with the center of curvature being on the central axis of the camshaft.

As described above, the swinging members 14 and 14' are swung to change the valve timing by the driving motor 19 by way of the reciprocating shaft 18 and the connecting rods 17 and 17'. Now an example of a control system for controlling the driving motor 19 will be described referring to FIGS. 6 and 7.

Figure 6:
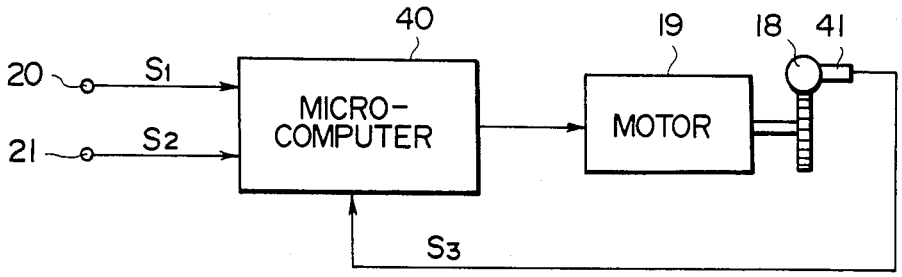
FIG. 6 is a schematic view of an example of a controlling system for controlling the driving motor for actuating the valve timing changing mechanism according to the operating condition of the engine.

As shown in FIG. 6, the driving motor 19 is controlled by a microcomputer 40 into which the output signals S1 and S2 from the rotational speed sensor 20 and the load sensor 21 are inputted. A position sensor 41 is provided for detecting the position of the reciprocating shaft 18. The output signal S3 of the position sensor 41 is inputted into the microcomputer 40.

Figure 7:
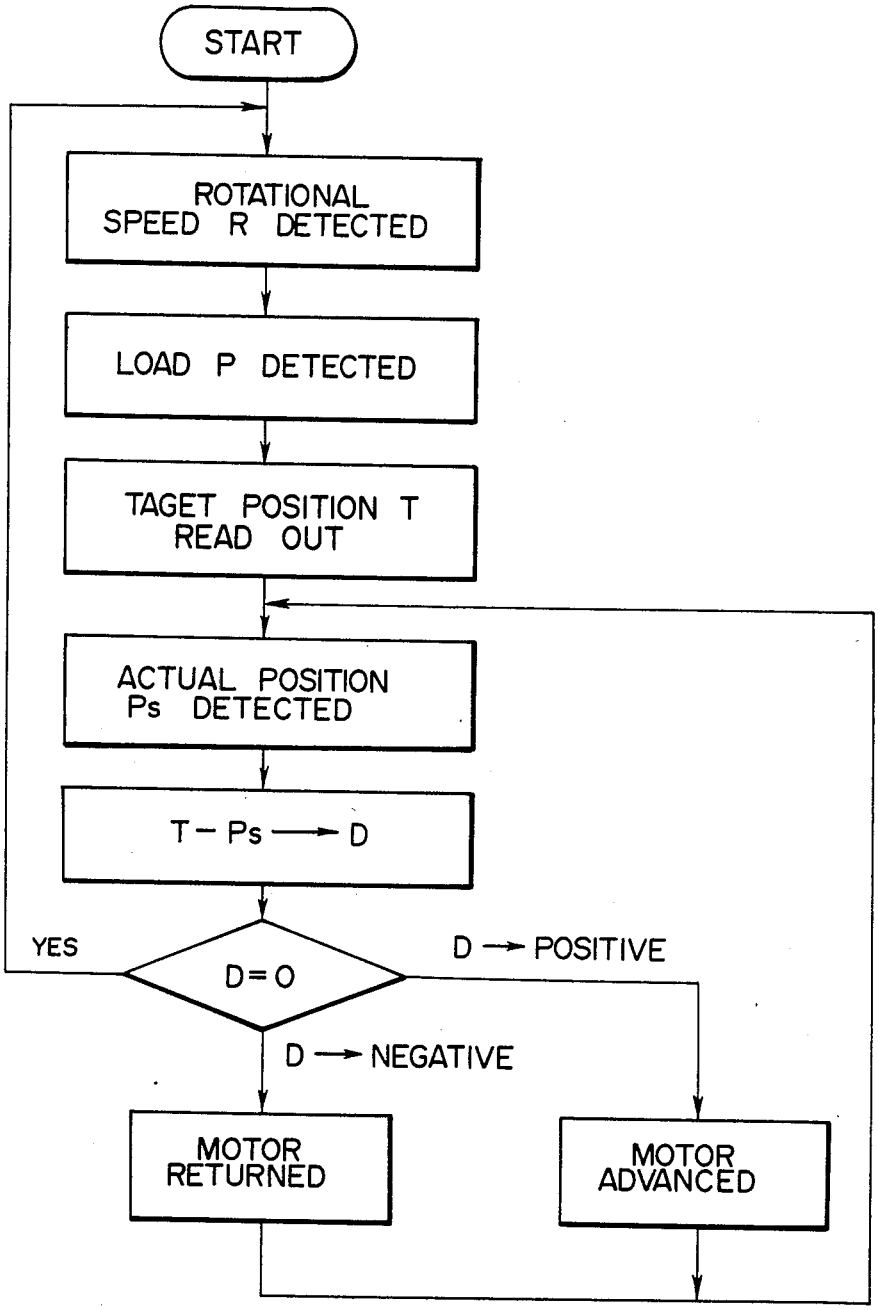
FIG. 7 is a flow chart of the operation of the microcomputer employed in the system shown in FIG. 6.

FIG. 7 shows the flow chart of the operation of the microcomputer 40. The computer 40 first determines the rotational speed R of the engine from the output signal S1 of the rotational speed sensor 20 and then determines engine load P from the output signal S2 of the load sensor 21. The microcomputer 40 has a ROM in which is stored a map representing the relationship of the target position T of the reciprocating shaft 18 to the rotational speed R and the engine load P, and the computer 40 reads out the target position T of the reciprocating shaft 18 corresponding to the rotational speed R and the engine load P determined. Then the actual position Ps of the reciprocating shaft 18 is determined from the output signal S3 of the position sensor 41. The difference D between the target position T and the actual position Ps of the reciprocating shaft 18 is calculated subsequently. When the difference D is nil, the driving motor 19 is not actuated and the reciprocating shaft 18 is held in the position. When the difference D is positive or negative the driving motor 19 is actuated to rotate in one direction or the other direction to move the reciprocating shaft 18 by an amount corresponding to the absolute value of the difference D back or forth according to the sign of the difference D. When the map stored in the ROM is appropriately arranged, the valve timing can be continuously changed with increase in load and/or rotational speed.

Figure 4:
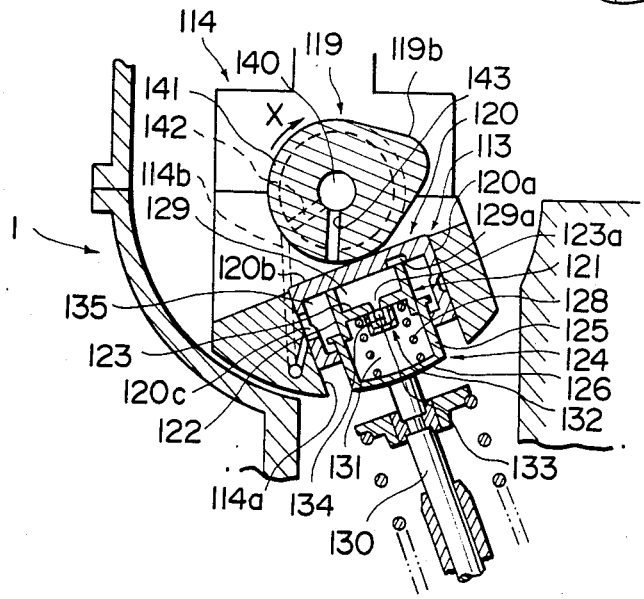
FIG. 4 is a fragmentary cross-sectional view showing a modification of the embodiment shown in FIG. 1.

Though in the above embodiment, the movement of each cam is transmitted to each valve by way of the box-like tappet member, the tappet member may be of various other types. For example, a hydraulic tappet device as shown in FIG. 4 may be used. The hydraulic tappet device is advantageous in that it is always in contact with the cam without generating a so-called valve clearance therebetween even when the engine is operating at a high speed, and therefore the movement of the cam can be transmitted to the valve stem in an optimal manner.

In FIG. 4, the hydraulic tappet device 113 includes a first member 120 which has a cylindrical side wall 120*a* and a base wall 120*b* on one end of the side wall 120*a* and is open at the other end of thereof. The first member 120 is snugly received in the tappet receiving hole 114*a* formed in the swinging member 114 for sliding movement in the axial direction of the valve stem 130 with the open end directed toward the valve stem 130. A second member 121 which has a cylindrical side wall 122 having a diameter smaller than that of the first member 120 is received in the first member 120. The second member 121 is substantially H-shaped in cross section and has a partition wall 123. The partition wall 123 is provided with a central orifice 123*a*, the purpose of which will become apparent later. A third member 124 has a cylindrical side wall 125 and a base wall 126 at one end, and is open at the other end. The open end of the third member 124 is inserted into the open end of the first member 120 with one end of the second member 121 being received in the open end of the third member 124 so that the third member 124 can be telescopically slid in liquid-tight fashion with respect to both the first and second members 120 and 121. A coil spring 128 is compressed between the inner surface of the base wall 126 of the third member 124 and the outer surface of the partition wall 123 of the second member 121 remote from the base wall 120*b* of the first member 120, whereby the second member 121 is resiliently pressed against the base wall 120*b* of the first member 120. Between the inner surface of the base wall 120*b* of the first member 120 and the inner surface of the partition wall 123 of the second member 121 is formed an oil well 129. A hydraulic pressure chamber 131 is formed between the inner surface of the base wall 126 of the third member 124 and the outer surface of the partition wall 123 of the second member 121. Said central orifice 123*a* in the partition wall 123 communicates the oil well 129 with the hydraulic pressure chamber 131. A check valve 132 comprising a ball 133 and a coil spring 134 for urging the ball 133 against the outer surface of the partition wall 123 to close the central orifice 123*a* is disposed on the outer surface of the partition wall 123. The camshaft 119 having a cam 119*b* mounted thereon is provided with a longitudinal oil passage 140 extending in the longitudinal direction of the camshaft 119 and an annular oil passage 141 formed on the outer periphery thereof, the annular oil passage 141 being connected with the longitudinal oil passage 140 by way of a radial oil passage 142. The longitudinal oil passage 140 is connected to an oil pump (not shown). The swinging member 114 supporting the hydraulic tappet device 113 is provided with an oil passage 114*b* which is opposed to the annular oil passage 141 at one end and opens in a communicating opening 120*c* formed in the side wall 120*a* of the first member 120 at the other end. Oil fed through the longitudinal oil passage 140 in the camshaft 119 under pressure is introduced into the annular space 135 formed between the outer surface of the side wall 122 of the second member 121 and the inner surface of the side wall 120*a* of the first member 120 by way of the radial oil passage 142, the annular oil passage 141, the oil passage 114*b* in the swinging member 114 and the communicating opening 120*c*, and into the oil well 129 through a communicating passage 129*a* formed between the inner surface of the base wall 120*b* of the first member 120 and the outer end of the side wall 122 of the second member 121. Further, the oil introduced into the oil well 129 is fed to the hydraulic pressure chamber 131 under pressure through the central orifice 123*a* of the second member 121. The check valve 132 permits the oil to flow into the pressure chamber 131 but prevents flow of oil from the pressure chamber 131 to the oil well 129. As oil is introduced into the pressure chamber 131 the third member 124 moves away from the base wall 120*b* of the first member 120 to extend the overall length of the tappet device 113 and finally the outer surface of the base wall 120*b* of the first member 120 and the outer surface of the base wall 126 of the third member 124 abut against the cam 119*b* and the top surface of the valve stem 130, respectively.

When the cam lobe of the cam 119*b* comes around and the tappet device 113 is pushed downward, the tappet device 113 acts like a solid tappet member to push the valve stem 130 downward, since the oil in the pressure chamber 131 cannot escape from the chamber 131 under the action of the check valve 132. When a clearance is generated between the cam 119 and the outer surface of the base wall 120*b* of the first member 120, the hydraulic pressure in the pressure chamber 131 is reduced. Accordingly, oil flows into the pressure chamber 131 through the central orifice 123*a* to lift the first member 120 by way of the second member 121, whereby the clearance is taken up.

Reference numeral 143 in FIG. 4 indicates an oil passage for lubricating the surface of the cam 119 and the outer surface of the base wall 120*b* in contact with the cam 119.

Though in the embodiment shown in FIG. 1, the present invention is applied to a dual-induction type internal combustion engine in which a valve 7 is provided in the heavy load intake port so that intake gas is actually fed through the heavy load intake port only during heavy load operation of the engine, the present invention can be applied to any type of engine. For example, the valve 7 need not be provided in the heavy load intake port. The present invention may be applied even to a single cylinder-engine.

Further, in the above embodiment, only the timing of the heavy load intake valve is changed with the timing of the light load intake valve being fixed. However, both the intake valves may be changed in their respective timings according to the operating condition of the engine. For example, the timing of the light load intake valve may be advanced with the timing of the heavy load intake valve being retarded to further extend the total intake valve opening time during heavy load high speed operation of the engine. The valve timing may be continuously changed with change in operating condition of the engine such as the rotational speed or load. For example, when the timing of the heavy load intake valve and the second exhaust valve is gradually retarded with increase in the rotational speed of the engine, torque-shock which could occur if the total intake valve opening time is abruptly changed by a large amount can be avoided.

Further in the embodiment shown in FIG. 1, all the intake valves of the four cylinders are arranged on one side of the center line of the engine block and all the exhaust valves of the four cylinders are arranged on the other side of the same, and the order of the intake valves and the exhaust valves in each cylinder is arranged so that the heavy load intake valves of the first and second cylinders, and the third and fourth cylinders are positioned adjacent to each other in the respective cylinder pairs, and so that the second exhaust valves are positioned adjacent to each other in the respective cylinder pairs. This arrangement is advantageous in that the timing of the heavy load intake valves and the second exhaust valves of the two cylinders can be changed using a single swinging member without interfering with the bearing portions supporting the camshafts at three points. However, any other arrangements of the valves may be used instead.

Further, though in the above embodiment, the swinging members 14 and 14' are normally held in the position in which valve timings shown by the solid line in FIG. 5 are given, and are moved to the position in which valve timings shown by the chained line in FIG. 5 is given during heavy load high speed operation of the engine, the swinging members 14 and 14' may be normally held in the latter position to be moved to the former position during operation of the engine under other conditions. If necessary, the total intake valve opening time may instead be changed according to any other operating condition of the engine.

Figure 8:
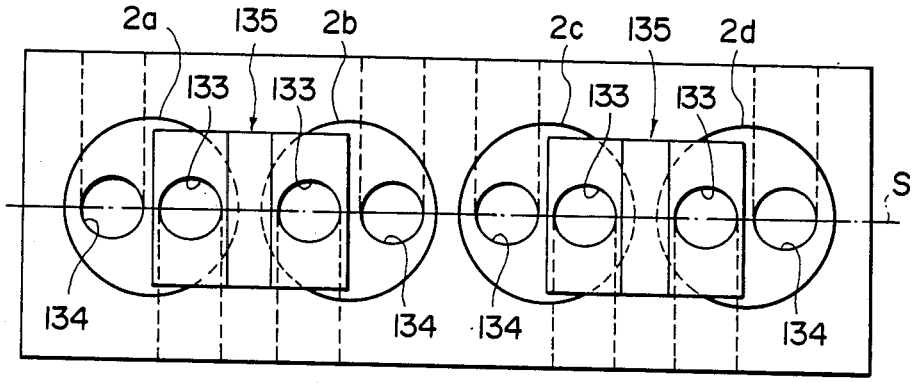
FIG. 8 is a schematic plan view of a four-cylinder engine having a single intake valve and a single exhaust valve for each cylinder and employing a valve timing control system of the present invention.

Though in the above embodiment the valve timing control system of the present invention is used for changing the total valve opening time, the valve timing control system of the present invention may, of course, be used to retard or advance the valve timing of an engine having a single intake valve and a single exhaust valve for each cylinder. The engine shown in FIG. 8 has four cylinders 2*a* to 2*d*, each of which is provided with a single intake valve 133 and a single exhaust valve 134. The intake valve 133 and the exhaust valve 134 are arranged in a line along the central axis S of the camshaft in this order as seen from the left in the second and fourth cylinders 2*b* and 2*d* and in the reverse order in the first and third cylinders 2*a* and 2*c*, so that the intake valves 133 of the first and second cylinders 2*a* and 2*d* are adjacent to each other, and those of the third and fourth cylinders 2*c* and 2*d* are adjacent to each other. The tappet members (not shown) associated with the intake valves 133 of the first and second cylinders 2*a* and 2*b* are supported by a common swinging member 135 similar to the swinging member 14 shown in FIG. 3. Similarly, the tappet members associated with the intake valves 133 of the third and fourth cylinders 2*c* and 2*d* are supported by another swinging member 135. The swinging members 135 may be driven in the manner described above. When the valve timing of the exhaust valves is to be changed, the order of the intake valve 133 and the exhaust valve 134 in each cylinder is reversed so that the exhaust valves 134 of the first and second cylinders 2*a* and 2*b*, and those of the third and fourth cylinders 2*c* and 2*d* are respectively adjacent to each other. Further, if desired, each intake valve 133 (each exhaust valve 134) may be supported by a separate swinging member 135.

In the embodiment described above, the swinging members 14 and 14' are suspended from the camshafts 9 and 10. However, the swinging members may be supported on the engine block as shown in FIGS. 9 and 10.

Figure 9:
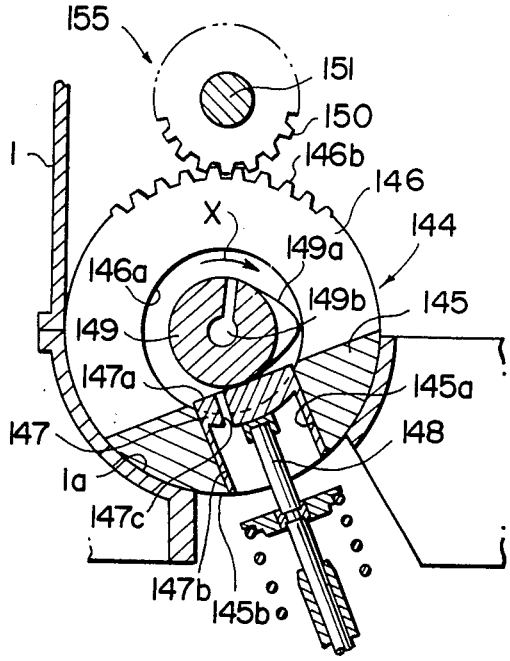
FIG. 9 is a fragmentary cross sectional view illustrating another embodiment of the present invention.
Figure 10:
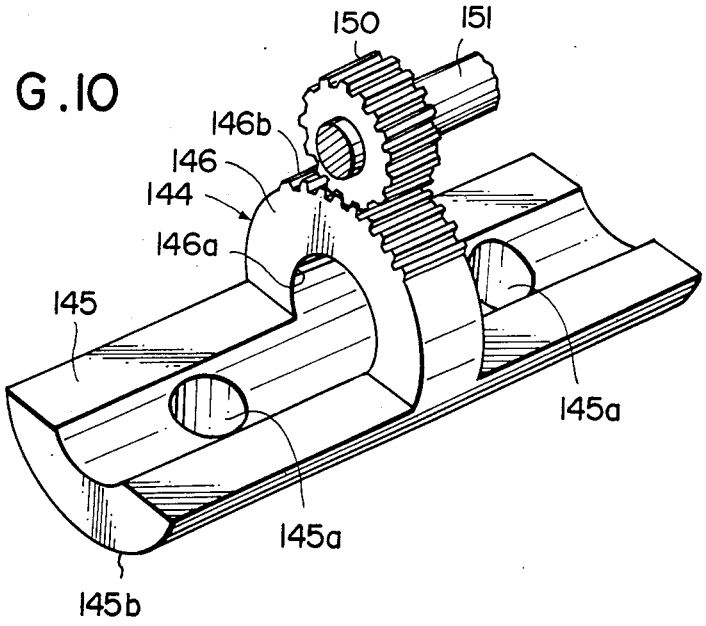
FIG. 10 is an enlarged perspective view of the swinging member of the embodiment shown in FIG. 9.

In FIGS. 9 and 10, the engine block 1 is provided with an arcuate guide surface 1*a* having its center of curvature on the central axis of the camshaft 149. The swinging member 144 comprises a horizontal portion 145 which is semicylindrical in cross section and an annular vertical portion 146 vertically extending from the horizontal portion 145 at the center thereof. The horizontal portion 145 is provided with a pair of tappet receiving holes 145*a* on opposite sides of the vertical portion 146. The outer surface 145*b* of the horizontal portion 145 has a curvature conforming to the guide surface 1*a* of the engine block 1. The vertical portion 146 is provided with a camshaft receiving bore 146a and sector gear 146*b*. The swinging member 144 is supported on the engine block 1 with the outer surface 145*b* of the horizontal portion 145 being in contact with the guide surface 1*a* of the engine block 1 and the camshaft receiving bore 146*a* of the vertical portion 146 receiving therein the camshaft 149. A tappet member 147 is snugly received in each tappet receiving hole 145*a* to transmit the movement of the cam 149*a* on the camshaft 149 to the valve stem 148. The control device 155 comprises a gear 150 fixed to a rotational shaft 151 and meshed with the sector gear 146*b* on the vertical portion 146, and a driving motor (not shown) for rotates the gear 150 by way of the rotational shaft 151. When the gear 150 is driven by the driving motor, the swinging member 144 is swung or rotated about the camshaft 149 by way of the engagement between the gear 150 and the sector gear 146*b* guided by the guide surface 1*a* of the engine block 1, whereby the relative position of the tappet member 147 to the cam 149*a* at a given angular position of the camshaft 149 is changed and the valve timing is changed.

As can be seen from FIG. 9, the tappet member 147 in this embodiment is in the form of a cylindrical member which has a thickened bottom wall 147*a* and a cylindrical side wall 147*b* and opens at one end. The outer surface of the bottom wall forms the cam abutting surface and the inner surface of the same forms the valve stem abutting surface, the valve stem 148 extending into the side wall 147*b* to abut against the inner surface of the bottom wall 147*a*. The inner surface of the bottom wall is curved and the center of curvature is on the central axis of the camshaft 149 for the reason described above in conjunction with the box-like tappet member shown in FIG. 2. The tappet member 147 is further provided with an oil hole 147*c* extending through the bottom wall 147*a*. Oil discharged from the oil passage 149*b* formed in the camshaft 149 flows to the inner surface of the bottom wall 147*a* to lubricate the surface in contact with the valve stem 148.

What is claimed is:

1. In an internal combustion engine having a camshaft, having an axis of rotation, bearing thereon a cam and a tappet member which transmits the movement of the cam to the stem of a valve to open and close the valve in a timed relation, a valve timing control system comprising a swinging member which is mounted for pivotal movement about said axis of rotation of the camshaft and is provided with a tappet receiving hole for receiving the tappet member to permit sliding movement of the tappet member therein to transmit the movement of the cam to the valve stem, and a control device which swings the swinging member together with the tappet member received in the tappet receiving hole according to the operating condition of the engine so that the relative position of the tappet member to the cam at a given angular position of the camshaft is changed, said tappet member having a cam abutting surface at one end and a valve stem abutting surface at the other end, said valve stem abutting surface being arcuately convex toward the valve, the center of curvature thereof being on the axis of rotation of the camshaft.

2. A valve timing control system as defined in claim 1 in which said swinging member is supported on the camshaft.

3. A valve timing control system as defined in claim 1 in which said swinging member is supported on the engine block.

4. A valve timing control system as defined in claim 1 in which said engine has a plurality of cylinders and said swinging members for changing the valve timing of adjacent cylinders are formed integrally with each other.

5. A valve timing control system as defined in claim 1 in which said tappet member is like a box having a side wall and end walls, the side wall being snugly received in said tappet receiving hole for sliding movement of the tappet member therein, the outer surface of one end wall forming said cam abutting surface, and the outer surface of the other end wall forming said valve stem abutting surface.

6. A valve timing control system as defined in claim 5 in which said end walls of the tappet member are provided with oil holes extending therethrough which permit oil discharged from the camshaft to reach the valve stem abutting surface by passing through the oil holes to lubricate the valve stem abutting surface.

7. A valve timing control system as defined in claim 1 in which said tappet member is a hydraulic tappet device.

8. A valve timing control system as defined in claim 1 in which said tappet member is provided with an oil hole communicating the cam abutting surface with the valve stem abutting surface.

9. An internal combustion engine comprising at least one cylinder, a camshaft having an axis of rotation and at least two cams which respectively open and close corresponding valves in a timed relation, and a valve timing control system which controls the opening and closing timing of one of said valves, wherein another of said valves is opened and closed at a constant timing regardless of the rotating speed of said camshaft, and said timing control system comprises a tappet member disposed between a valve stem of said one of the valves and the corresponding cam, a swinging member which is supported on said camshaft for pivotal movement about said axis of rotation of the camshaft and is provided with a tappet receiving hole for receiving said tappet member to permit sliding movement of the tappet member therein to transmit the movement of said cam to said valve stem, and a control devince which swings said swinging member together with said tappet member received in said tappet receiving hole according to the operating condition of the engine so that the relative position of said tappet member to said cam at a given angular position of the camshaft is changed.

10. An internal combustion engine as defined in claim 9 wherein each cylinder of the engine has at least two valves and the movement of one of said two valves is controlled by said control system and the other of said two valves opens and closes at a timing determined by the engine speed.

11. An internal combustion engine as defined in claim 10 wherein said valves are intake valves.

12. An internal combustion engine as defined in claim 10 wherein said valves are exhaust valves.

13. An internal combustion engine as defined in claim 10 wherein said engine has a plurality of cylinders and said swinging members for the valves of different cylinders adjacent to each other are formed into a common member.

14. An internal combustion engine as defined in claim 1 wherein said tappet member is cylindrically shaped and said valve stem abutting surface is spherical.

15. An internal combustion engine as defined in claim 1 wherein said swinging member is supported by said camshaft and said tappet member comprises a hydraulic tappet device.

* * * * *